United States Patent [19]

Kudermann et al.

[11] Patent Number: 4,568,192

[45] Date of Patent: Feb. 4, 1986

[54] HIGH TEMPERATURE MAGNETIC STIRRER

[75] Inventors: Gerhard Kudermann, Alfter; Karl-Heinz Blaufuss, Windhagen, both of Fed. Rep. of Germany

[73] Assignee: Vereinigte Aluminium-Werke Aktiengesellschaft, Fed. Rep. of Germany

[21] Appl. No.: 588,549

[22] Filed: Mar. 12, 1984

[30] Foreign Application Priority Data

Mar. 12, 1983 [DE] Fed. Rep. of Germany ..... 3308892

[51] Int. Cl.[4] ..... B01F 13/08

[52] U.S. Cl. ..... 366/146; 219/433; 366/273; 422/78; 422/99; 422/199

[58] Field of Search ..... 366/146, 273, 274; 422/78, 80, 99, 199; 219/425, 432, 433, 535

[56] References Cited

U.S. PATENT DOCUMENTS

| | | | |
|---|---|---|---|
| 2,535,731 | 12/1950 | Goodenrath | 219/433 |
| 3,028,476 | 4/1962 | Hug | 366/146 X |
| 3,433,465 | 3/1969 | Szpur | 219/433 X |
| 3,554,497 | 1/1971 | Zipperer | 366/274 X |
| 3,766,360 | 10/1973 | Eddleman et al. | 219/432 X |
| 3,790,749 | 2/1974 | Lee | 219/425 X |
| 3,864,088 | 2/1975 | Delin et al. | 422/80 |

FOREIGN PATENT DOCUMENTS

| | | | |
|---|---|---|---|
| 131024 | 1/1949 | Australia | 219/432 |
| 2082929 | 3/1982 | United Kingdom | 366/274 |

OTHER PUBLICATIONS

"Sobers Vertical Combustion Furnace", Hevi Duty Electric Company, Bulletin HD 1040, PTO dated 11-1-2-1942.

*Primary Examiner*—Philip R. Coe

*Attorney, Agent, or Firm*—Darby & Darby

[57] ABSTRACT

Disclosed is a high temperature magnetic stirrer including a permanent magnet positioned underneath a frame supported platform. The magnet is positioned to be rotatable in a plane parallel to the platform. A spiral shaped heating element mounted to the frame is positioned above the platform and centered above the rotatable magnet. The spiral has a diameter sufficient to enclose a portion of a crucible. Means are provided to supply the heating element with electricity, and additional means are secured to the frame to rotate the magnet.

6 Claims, 1 Drawing Figure

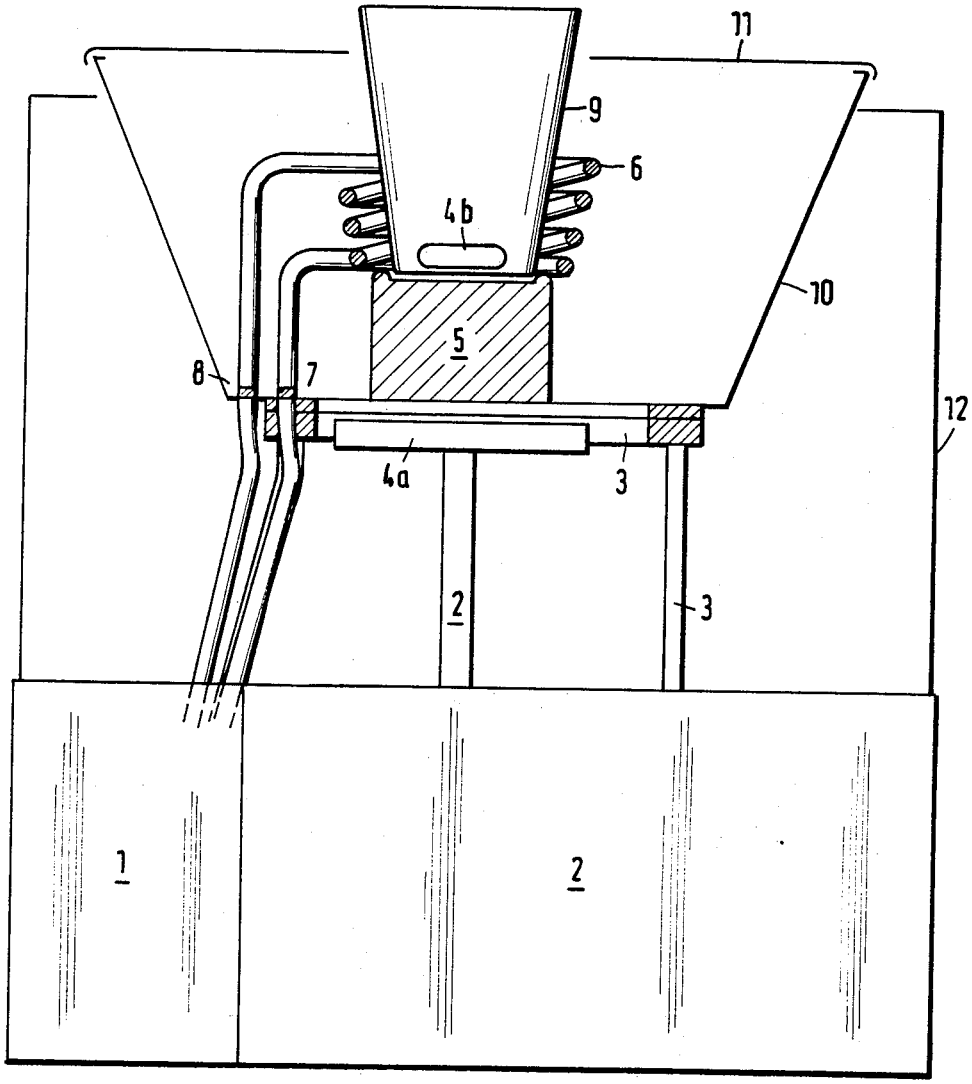
11
9
6
4b
10
5
8
7
12
4a
3
2
3
1
2

HIGH TEMPERATURE MAGNETIC STIRRER

FIELD OF INVENTION

The invention relates to a high temperature magnetic stirrer for use, e.g., in analytical chemistry for dissolution processes.

BACKGROUND OF THE INVENTION

Heatable magnetic stirrers for dissolution processes which have a heatable crucible base of nonmagnetic steel or aluminum are well known. A conventional heatable magnetic stirrer includes a heating plate, having heating elements positioned directly below the lower surface of the plate, and a variable speed motor driving a rotatable permanent magnet. The magnet rotates in a plane parallel to and directly below the heating plate. To use the stirrer, a vessel containing material to be heated is positioned on the heating plate. The vessel is heated by conduction of the heat produced by the heating elements to the heating plate and then to the bottom surface of the vessel. A steel stirring bar is placed in the vessel, and the motor is turned on, rotating the permanent magnet. The rotation of the magnet establishes a rotating magnetic field, which in turn causes the stirring bar to rotate within the vessel, thereby causing its contents to be stirred.

In analytical chemistry, vessels for use at higher temperatures, (i.e. crucibles) made of platinum or glass-carbon (i.e. vitreous carbon), are known. In known heatable magnetic stirrers, heat is transmitted to the crucible at the base of the crucible, from the heating plate surface of the stirrer.

With certain materials that do not readily undergo acid dissolution, such as corundum, titanium ores, ashes, dusts, salts, and the like, high temperatures (above 350° C.) must be achieved rapidly to avoid vaporization of the dissolution liquor which could lead to undesirable alteration of the reaction conditions.

Furthermore, in conventional heatable magnetic stirrers, the temperature gradient from the bottom to the surface of the liquor is relatively high at the temperatures attainable. Because the fluid boils, a fast and high overheating of the liquor is limited. For dissolution of stable samples e.g., corundum or cement, temperatures above the boiling point of the acids are required.

Theoretically it is possible to conduct dissolution of this type by using a magnetic stirrer with a heating plate. Heating plates are usually made of aluminum alloys or vanadium steel. Unfortunately, vanadium steel has an unfavorable coefficient of expansion and has a tendency to deform at temperatures as low as 400° C. The aluminum alloy, e.g., AlSi, loses mechanical stability above 450° C. and becomes soft, which can result in short circuiting of the heating elements.

Moreover, care must be taken in using conventional heatable magnetic stirrers at high tempertures to ensure that heating does not heat up the permanent magnet of the stirrer and thereby reduce its magnetic field. Permanent magnets lose their permanent magnetic properties above 400° C. With conventional heatable magnetic stirrers, design and material limits are exceeded when high temperatures are attained too quickly, even if the high temperatures are maintained for a short period of time. When the crucible is made of platinum, direct contact between the platinum crucible and the heating plate at high temperatures causes diffusion phenomena which result in alloy formation on the platinum surface and in the long run causes localized damage to the heating plate due to melting of the crucible.

Use of a glass-carbon crucible entails the danger of oxidation above temperatures of approximately 400° C. Therefore, rapid heat transfer by a sufficiently highly heated crucible surface leads to oxidation, and thereby destruction, of the crucible.

In addition to the problem of self destruction, high temperature heating in a conventional heatable magnetic stirrer causes contamination of the material being heated. For example, oxidation of the crucible will change the reaction conditons within the material being heated. This presents a particularly large problem when analytical work is conducted.

OBJECT OF THE INVENTION

The object of the present invention is to provide a heatable magnetic stirrer for high-temperature dissolution processes which can withstand rapid increase in temperature and maintain a magnetic field despite surrounding high temperatures.

Moreover, the construction should allow high overheating of the liquor, i.e., 370° to 400° C., to be achieved rapidly without danger of sputtering. Furthermore, contamination of the decomposition vessel and work material through diffusion or oxidation is eliminated.

SUMMARY OF THE INVENTION

The object of the invention is met by providing a high temperature magnetic stirrer including a permanent magnet positioned underneath a frame supported platform. The magnet is positioned to be rotatable in a plane parallel to the platform. A spiral shaped heating element mounted to the frame is positioned above the platform and centered above the rotatable magnet. The spiral has a diameter sufficient to enclose a portion of a crucible. Means are provided to supply the heating element with electricity, and additional means are secured to the frame to rotate the magnet.

DETAILED DESCRIPTION

In the following detailed description, certain specific terminology will be utilized for the sake of clarity and a particular embodiment described. However, it is to be understood that the same is not intended to be limiting and should not be so construed as the invention is capable of taking different forms and variations within the scope of the appended claims.

Referring to the drawing, there is shown a schematic view of the high temperature magnetic stirrer of the present invention.

Support frame 3 provides a platform for the magnetic stirrer. Adjustable speed electric motor and vertical shaft 2 are positioned below frame 3. Affixed to the end of shaft 2 is permanent magnet bar 4*a*. Magnet 4*a* is mounted perpendicularly to shaft 2, such that rotation of shaft 2 causes bar 4*a* to spin in a plane parallel to the platform formed by frame 3. Magnetic bar 4*a* is made of sintered magnetic steel, and has dimensions of approximately $5\times30\times50$ mm.

On the upper surface of the platform of frame 3 is located crucible base 5. Base 5 is cylindrical and is made of ceramic material (e.g. porcelain, sintered $Al_2O_3$, or similar heat resistant materials that can withstand temperatures greater than 350° C., such as platinum or vitreous carbon). Base 5 is centered above shaft 2, but is not secured to the platform of frame 3. The upper surface of base 5 contains a lip along the edge. Platinum crucible 9 is placed on base 5, within the depression formed by the lip on the upper surface. Crucible 9 is surrounded by spiral 6.

Heating spiral 6, shown in cross section, is centered above base 5 and is coiled such that it forms an inverted conical frustum, the smallest diameter corresponding approximately to the diameter of base 5. The diameter increases with the height above base 5. The spiral is ideally made of CrNi (chromium-nickel) steel, but other materials capable of attaining high temperatures can be used. The leads 7,8 of the spiral are electrically connected to variable energy source 1 below base 5. Thus, the electrical connections are protected from mechanical and thermal effects present above the base 5. Radiant heat shroud 10 encloses the upper surface of the platform of stand 3, the crucible base 5, the heating spiral 6, and crucible 9 in an inverted frustoconical shape. Shroud 10 is made from CrNi steel and serves to reflect heat emanating outwardly from spiral 6 back towards crucible 9. The shroud also protects the permanent magnet from the heat produced by the spiral. Lid 11 is supplied to cover the opening formed by shroud 10. A circular opening is provided in the center of lid 10 to allow the upper edge of crucible 9 to extend thereabove. The entire heatable magnetic stirrer is insulated by insulation shield 12. Shield 12 is provided to keep heat within the heatable magnetic stirrer and to increase the safety of the unit by ensuring a relatively low surface temperature.

To use the heatable magnetic stirrer of the present invention, a crucible of desired size is placed on crucible base 5. Bases of different height can be used to accommodate various size crucibles, and ensure optimum placement of the crucible relative to the heating spiral to provide maximum heat transfer. It is desirable to place the crucible such that the gap between the crucible and heating spiral is approximately 2.5 to 5 mm. A stirring bar **4*b*, of appropriate size for the crucible, is placed within the crucible containing material to be heated. The stirring bar is generally cylindrical, made of steel and has a coating of vitreous carbon or polytetrafluoroethylene. After crucible 9 has been properly positioned within spiral 6, lid 11 is placed over the heater-stirrer with the upper edge of the crucible extending above the edge of the lid. Electric motor 2 is then energized to rotate the permanent magnet 4*a* which in turn results in rotation of its magnetic field. The rotating field causes steel bar 4*b* contained within crucible 9** to spin, resulting in the contents of the crucible being stirred.

The heating spiral 6, which is part of an electric circuit, is charged with electricity from variable energy source 1, causing the spiral to heat up, radiating heat.

The high temperature magnetic stirrer of the present invention allows heat transfer to occur over a large surface area of the crucible without direct contact between the heating spiral and the crucible. Consequently, even at temperatures in the vicinity of 400° C., no localized overheating can occur so there is no danger of premature oxidation. The spiral design also reduces the effect of the force of the magnetic field on the heating spiral.

The heating provided by heating spiral 6 eliminates the risk of diffusion at the crucible base. The heating spiral attains temperatures of approximately 700° C. without danger to the crucible, permanent magnet, heater leads, or drive unit.

EXAMPLE 1

A comparison was carried out with a conventional magnetic stirrer and the stirrer of the present invention. To achieve the necessary dissolution temperature, the conventional heating plate had to be insulated on its sides with mineral wool so that the steel plate could reach a temperature of approximately 500° C.

A platinum crucible with a capacity of approximately 50 ml was filled with 85% phosphoric acid as solvent and poorly decomposable aluminum oxide introduced with stirring in a ratio of 1 g (gram) aluminum oxide to 12 g phosphoric acid.

After fifteen minutes of heating, incipient melting of the crucible was observed. When dissolution was completed after twenty minutes, the platinum crucible had adhered to the heating plate. Apparently an intermetallic phase had formed through diffusion. The reaction mixture had shown a tendency to spatter during dissolution. After dissolution it was found that insoluble deposits had formed in the phosphoric acid—presumably as a result of localized overheating—which were later identified as polyphosphates.

EXAMPLE 2

The experiment of Example 1 was repeated using the high temperature magnetic stirrer of the present invention. Dissolution took only 6 minutes and a temperature of 800° C. was attained. No contaminants were found in the resultant product.

The high temperature stirrer of the present invention may be used to stir fluids at temperatures on the order of 700° C.

What is claimed is:

1. A high temperature magnetic stirrer for stirring and rapidly heating materials placed within a crucible to sustained temperatures of up to 800° C. comprising:

a frame-supported platform;

a permanent magnet positioned underneath the platform, said magnet rotatable in a plane parallel to said platform;

rotating means secured to said frame for rotating said magnet;

a heating element having a spiral shaped portion, said element mounted to the frame, positioned above the platform and centered above the rotatable magnet;

a crucible, a portion of said crucible being surrounded by the spiral shaped portion of said heating element;

a shroud encircling said heating element and the upper surface of said platform, said shroud insulating said magnet from excessive heat created by said heating element and additionally reflecting heat produced by said heating element back towards said crucible; and means for providing said heating element with electrical energy.

2. The magnetic stirrer of claim 1 additionally comprising a lid for covering the area encircled by said shroud, said lid having a central opening to enable said crucible placed within the stirrer to extend above the surface of said lid.

3. The magnetic stirrer of claim 1 further comprising a ceramic base for placement on said platform below said heating element, said base capable of supporting said crucible.

4. The magnetic stirrer of claim 1 wherein said spiral shaped portion of said heating element is in the shape of an inverted frustum.

5. The magnetic stirrer of claim 4 wherein the smallest diameter of said inverted frustum is approximately equal to the diameter of said magnet.

6. The magnetic stirrer of claim 1 wherein said shroud is in the shape of an inverted frustum.

* * * * *